US006961973B1

(12) United States Patent
Smith

(10) Patent No.: US 6,961,973 B1
(45) Date of Patent: Nov. 8, 2005

(54) COMBINATION TOOL WITH HAMMER HEAD, CRESCENT WRENCH AND PIPE WRENCH

(76) Inventor: Cole J. Smith, 814 N. Mead, Glendive, MT (US) 59330

( * ) Notice: Subject to any disclaimer, the term of this patent is extended or adjusted under 35 U.S.C. 154(b) by 0 days.

(21) Appl. No.: 10/887,725

(22) Filed: Jul. 9, 2004

(51) Int. Cl.[7] ..... B25F 1/00
(52) U.S. Cl. ..... 7/139; 7/143; 7/100; 81/168
(58) Field of Search ..... 7/139, 143, 100, 7/138; 81/119, 121.1, 165, 437

(56) References Cited

U.S. PATENT DOCUMENTS

| | | | | |
|---|---|---|---|---|
| 56,166 | A | | 7/1866 | Boardman |
| 74,568 | A | | 2/1868 | Meeker |
| 107,790 | A | | 9/1870 | Lawbaugh |
| 156,732 | A | | 11/1874 | Helms |
| 208,068 | A | | 9/1878 | Brown |
| 317,738 | A | | 5/1885 | Crosby |
| 352,216 | A | | 11/1886 | Aitken |
| 513,271 | A | | 1/1894 | Matthews |
| 708,447 | A | | 9/1902 | Wood et al. |
| 711,408 | A | | 10/1902 | Maggard |
| 780,305 | A | | 1/1905 | Riggin |
| 965,198 | A | | 7/1910 | Kinsel et al. |
| 990,543 | A | | 4/1911 | Gilchrist |
| 1,280,802 | A | | 10/1918 | Miller |
| 1,387,761 | A | | 8/1921 | Canelles |
| 1,413,798 | A | | 4/1922 | Shinn |
| 1,421,220 | A | | 6/1922 | Hart |
| 1,453,155 | A | | 4/1923 | Martinez |
| 1,465,009 | A | * | 8/1923 | Wasseth ..... 81/437 |
| 1,469,472 | A | | 10/1923 | Bangert |
| 1,609,507 | A | | 12/1926 | Bucciarelli |
| 1,866,426 | A | | 7/1932 | Siegrist |
| 2,091,538 | A | * | 8/1937 | Wasseth ..... 30/506 |
| 4,234,987 | A | | 11/1980 | Charette |
| 5,237,715 | A | | 8/1993 | Bane, III |
| 5,280,659 | A | | 1/1994 | Park |
| 5,845,354 | A | | 12/1998 | Long et al. |
| 6,298,754 | B1 | | 10/2001 | Brown |
| D467,478 | S | | 12/2002 | Harewood |

* cited by examiner

*Primary Examiner*—Lee D. Wilson
(74) *Attorney, Agent, or Firm*—Antoinette M. Tease

(57) ABSTRACT

A combination tool comprising a hammer head portion, a pipe wrench, a crescent wrench and a handle, wherein the pipe wrench and crescent wrench are located on opposite ends of the tool. The pipe wrench comprises an adjustable jaw and a fixed jaw, and the fixed jaw of the pipe wrench lies directly on top of the hammer head portion. The handle optionally comprises finger grips that can be formed out of the same material as the handle or a separate piece of material, such as rubber, that is wrapped around the outside of the handle. In the preferred embodiment, the length of the handle is in the range of four to ten inches, and the overall length of the tool is in the range of ten to twenty-four inches. The tool is preferably made of chrome-plated forged steel.

9 Claims, 2 Drawing Sheets

FIGURE 1
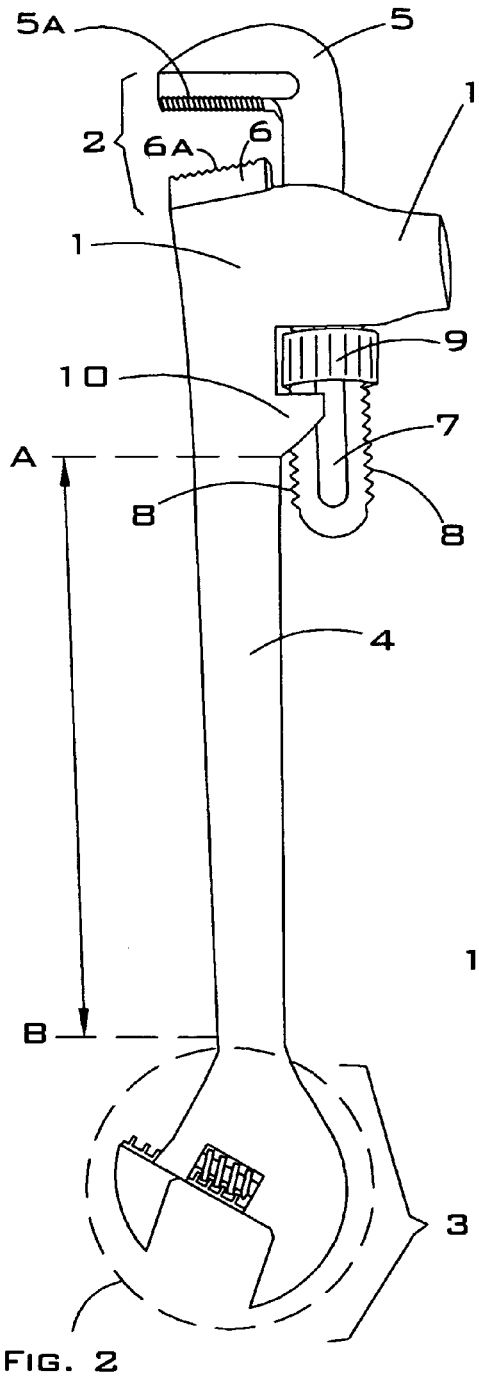
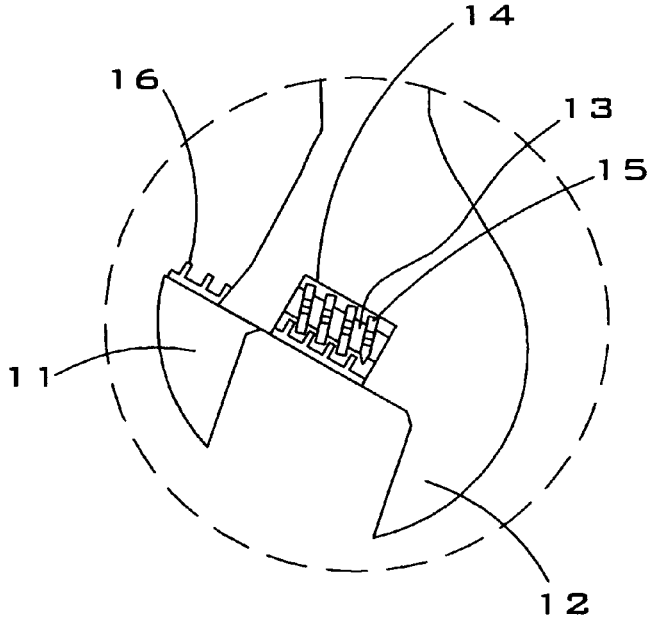
FIGURE 2

COMBINATION TOOL WITH HAMMER HEAD, CRESCENT WRENCH AND PIPE WRENCH

BACKGROUND OF THE INVENTION

1. Field of the Invention

The present invention relates to the field of hand tools, and more particular, a single hand tool that combines a hammer head, crescent wrench and pipe wrench.

2. Description of the Related Art

Inventors have been patenting multi-purpose hand tools since 1866, but no one has ever patented a tool that combines a hammer head, crescent wrench and pipe wrench, as in the present invention. In U.S. Pat. No. 56,166 (Boardman, 1866), the inventor described a tool with a hammer head, a claw for drawing nails, a pipe wrench, a screw driver bit and a rectangular socket that serves as a nut wrench. U.S. Pat. No. 74,568 (Meeker, 1868) discloses a combination hammer and screw wrench. The tool includes a claw for driving nails, and the claw and fixed jaw of the wrench are formed from the same piece.

U.S. Pat. No. 107,790 (Lawbaugh, 1870) provides a combination tool that includes a pair of pincer jaws, a slot for drawing nails, a hammer head and a screwdriver. U.S. Pat. No. 317,738 (Crosby, 1885) covers a combination tool comprised of a wrench, a claw for drawing nails, a screw driver blade, and a hammer head. In U.S. Pat. No. 513,271 (Matthews, 1894), the inventor described a tool with a hammer head and claw and a wrench. The bottom of the hammer head serves as the upper (non-moveable) portion of the wrench. The lower portion of the wrench is moved by a dowel pin and a series of dowel holes.

U.S. Pat. No. 708,447 (Wood et al., 1902) covers a tool that includes a monkey wrench, a hammer head, and a screwdriver. The handle of the tool has grooves that can be used as spoke wrenches. U.S. Pat. No. 711,408 (Maggard, 1902) provides a tool with a hammer head and claw. The claw also serves as the top of an adjustable wrench. The claw and slidable jaw of the wrench optionally include oppositely-directed teeth so that the device can be used as a pipe wrench.

The combination tool described in U.S. Pat. No. 965,198 (Kinsel et al., 1910) comprises a nut wrench, a small pipe or nipple wrench for detaching gas burners or other small devices, pliers with a cavity for extracting wire nails, a nail puller for more conventionally sized nails, a hammer and a screwdriver. U.S. Pat. No. 990,543 (Gilchrist, 1911) provides a tool that functions as a hammer, a nail puller, a wire cutter, a wire twister, and a staple puller. This same tool also includes a pair of pipe tongs, a rivet set, a leather punch, and a screwdriver or chisel.

U.S. Pat. No. 1,280,802 (Miller, 1918) provides a tool with a hammer head and claw that also serve as a pipe wrench and a nut wrench. This tool also has a suspension eye or ring for fitting the tool on the belt of the user or hanging the tool from a nail. U.S. Pat. No. 1,387,761 (Cannelles, 1921) discloses a tool with a hammer head, the lower part of which acts as the stationary top section of both a serrated and a non-serrated wrench. This tool includes a wire cutter. U.S. Pat. No. 1,413,798 (Shinn, 1922) is similar to the Miller and Cannelles patents in that it describes a tool with a hammer head that also acts as the upper section of both a pipe wrench and a nut wrench. The hammer head has a V-shaped slot in it for pulling nails, and the handle has a slot and openings in it for holding wire when it is being cut. The end of the handle that is opposite the hammer head forms a screwdriver and an "alligator" opening for stretching barb-wire.

U.S. Pat. No. 1,421,220 (Hart, 1922) provides a combination tool with a hammer head, a pipe wrench and a wire cutter. U.S. Pat. No. 1,453,155 (Martinez, 1923) discloses a tool with a hammer head, a pipe wrench, and a wire cutter. The tool described in U.S. Pat. No. 1,469,472 (Bangert, 1923) includes a hammer head, a wrench that can be used as either a monkey wrench or a pipe wrench, and a pipe cutter. U.S. Pat. No. 1,609,507 (Bucciarelli, 1926) covers a wrench that also has a hammer head and claw. U.S. Pat. No. 1,866,426 (Siegrist, 1932) discloses a combination tool comprising a pipe wrench, a screwdriver and a hammer head.

The tool described in U.S. Pat. No. 2,091,538 (Wasseth, 1937) comprises a hammer head, a nut wrench, a monkey wrench, a screwdriver, and a saw blade. Interestingly, no patents were issued for combination hand tools for the four-decade period between 1937 and 1980. The next patent to cover a combination hand tool was U.S. Pat. No. 4,234,987 (Charette, 1980), in which the inventor described a tool with a hammer head, a crescent wrench, and a screw wrench. U.S. Pat. No. 5,237,715 (Bane, III, 1993) discloses a tool called a "boatswain mate" that comprises a hammer head, a crescent wrench, an aperture in the handle for receiving a lanyard, a marline spike portion that can be used for separating the strands of a rope knot, and a screwdriver tip.

U.S. Pat. No. 5,280,659 (Park, 1994) marked the beginning of more complicated multipurpose hand tools, along the lines of the currently marketed LEATHERMAN®. The Park patent covers a multipurpose tool with four different working stations. Included in these working stations are a pair of nipping edges for cutting electric wire, scissoring edges for cutting a thin metal plate, a pair of jaw plates for insertion of snap rings or bearings, a pair of small serrations for holding a small pipe, a pair of cutting edges for cutting wires, a hammer, a pair of large serrations, a pair of pressing sections, and pairs of stripping sections for stripping the covering from electric wires. The tool also includes an adjustable wrench, a detachable screwdriver, a socket wrench, and bolt cutting holes. U.S. Pat. No. 5,845,354 (Long et al., 1998) provides a multipurpose tool that can open container caps, hammer nails, pull nails, act as a screwdriver, loosen and tighten a nut, open bottle caps, pry off lids, act as a vice grip tool, and act as a C clamp.

U.S. Pat. No. 6,298,754 (Brown, 2001) discloses a wrench for use in firefighting. On one end of the wrench is a spanner part with a projecting claw for engaging a pin on the circumference of a pipe or a hose coupling ring to be rotated by the tool.

Despite the numerous inventions discussed above, no one has yet patented a tool that has a hammer head, a pipe wrench and a crescent wrench, where the pipe wrench and crescent wrench are located on opposite ends of the tool to facilitate working in tight spaces, and where the hammer head is separate from the pipe wrench to prevent undue wear on the pipe wrench.

BRIEF SUMMARY OF THE INVENTION

The present invention is a combination tool comprising a hammer head portion, a pipe wrench, a crescent wrench and a handle. The pipe wrench comprises an adjustable jaw and a fixed jaw, the adjustable jaw of the pipe wrench comprises a serrated shank and a nut, the handle comprises a horizontal protrusion, the nut is confined between the hammer head portion and the horizontal protrusion, and the adjustable jaw of the pipe wrench is moved by turning the nut. The crescent wrench comprises an adjustable jaw, a fixed jaw, and a rotating member. The rotating member is attached to the body of the crescent wrench by a pin, the rotating member comprises raised spirals, the adjustable jaw of the crescent wrench comprises a serrated edge, the raised spirals are in contact with the serrated edge, and the adjustable jaw of the crescent wrench is moved by turning the rotating member.

The crescent wrench is located on one end of the tool and the pipe wrench is located on the opposite end of the tool, and the fixed jaw of the pipe wrench lies directly on top of the hammer head portion. The handle optionally comprises finger grips that can be formed out of the same material as the handle or a separate piece of material, such as rubber, that is wrapped around the outside of the handle.

In the preferred embodiment, the length of the handle is in the range of four to ten inches, and the overall length of the tool is in the range of ten to twenty-four inches. The tool of the present invention is preferably made of chrome-plated forged steel.

BRIEF DESCRIPTION OF THE DRAWINGS

FIG. 1 is a front view of a preferred embodiment of the present invention.

FIG. 2 is a front view of the crescent wrench aspect of the present invention.

REFERENCE NUMBERS

Figure 3:
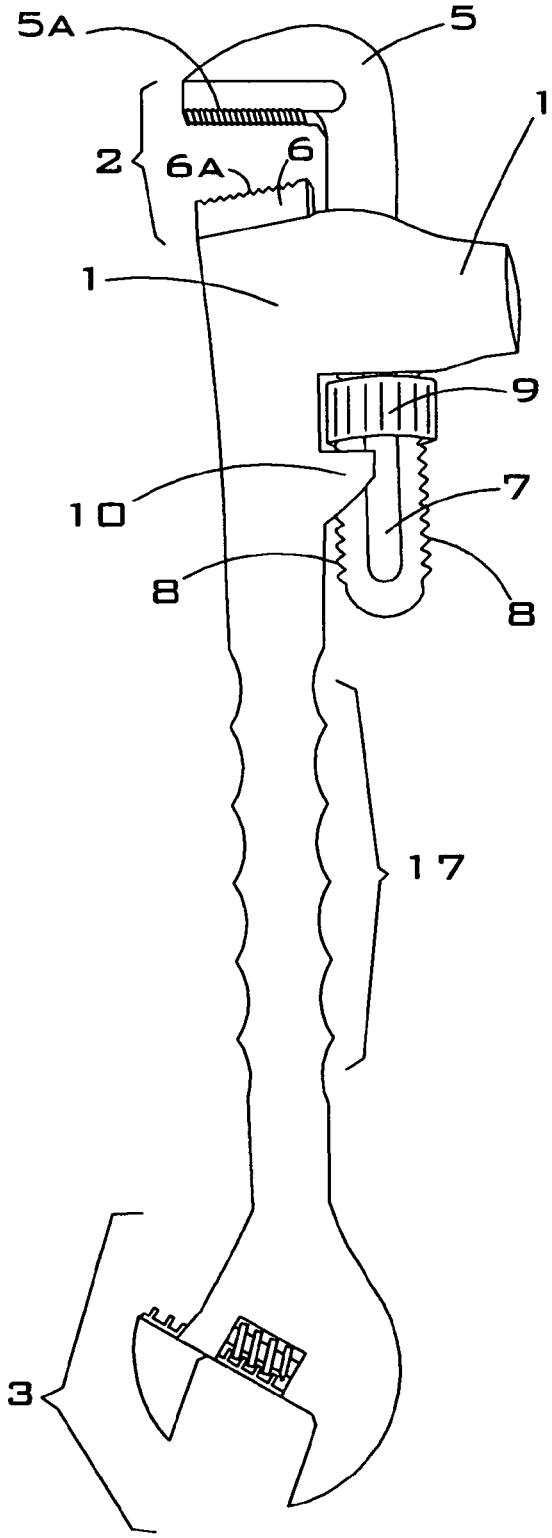
FIG. 3 is a front view of an alternate embodiment of the present invention.

1 Hammer head portion
2 Pipe wrench
3 Crescent wrench
4 Handle
5 Adjustable jaw of pipe wrench
5*a* Serrated edge of adjustable jaw of pipe wrench
6 Fixed jaw of pipe wrench
6*a* Serrated edge of fixed jaw of pipe wrench
7 Shank portion
8 Serrated edges of shank portion
9 Nut
10 Horizontal protrusion
11 Adjustable jaw of crescent wrench
12 Fixed jaw of crescent wrench
13 Rotating member
14 Cut-out in crescent wrench
15 Raised spirals
16 Serrated edge of adjustable jaw of crescent wrench
17 Finger grips

DETAILED DESCRIPTION OF INVENTION

FIG. 1 is a front view of a preferred embodiment of the present invention. This figure illustrates the combination tool of the present invention, which comprises a hammer head portion 1, a pipe wrench 2, a crescent wrench 3, and a handle 4.

The pipe wrench 2 comprises an adjustable jaw 5 and a fixed jaw 6. Both the adjustable jaw 5 and the fixed jaw 6 have serrated edges 5*a*, 6*a*. The adjustable jaw 5 comprises a shank portion 7 with serrated edges 8 and a nut 9. The adjustable jaw 5 can be moved up or down in relation to the fixed jaw 6 by turning the nut 9, which is threaded on the inside to engage the serrated edges 8 of the shank portion 7. The nut 9 is confined by the hammer head portion 1 on one side and a horizontal protrusion 10 on the other side. The confinement of the nut 9 by the hammer head portion 1 and the horizontal protrusion 10 ensure that when the nut 9 is turned, it will cause the adjustable jaw 5 to move up and down. Without the confinement of the nut 9, the nut 9 when turned would travel up and down the serrated shank 7, 8 without causing the adjustable jaw 5 to move.

As shown in FIG. 1, the fixed jaw 6 of the pipe wrench 2 lies directly on top of the hammer head portion 1. This configuration is superior to the configuration depicted in prior art, where the hammer head also functions as the adjustable jaw. In those configurations, the hammer head is not as stable and not able to deliver as forceful a blow as in the present invention. In the present invention, the hammer head is positioned on the pipe wrench end of the tool in recognition that most people are accustomed to using the pipe wrench as a hammer and will, therefore, be inclined to grab that end of the tool when they need a hammer. The hammer head is also located on the pipe wrench end of the tool because it could inhibit the function of the crescent wrench if located on that end of the tool. For optimum performance of the hammer, the pipe wrench should be closed in a closed position before using the hammer head.

The crescent wrench 3 comprises an adjustable jaw 11 and a fixed jaw 12. The adjustable jaw 11 can be moved closer to or further away from the fixed jaw 12 by turning the rotating member 13 that is located inside a cut-out 14 in the crescent wrench 3. The rotating member 13 is fixed to the body of the crescent wrench 3 by a pin (not shown) that runs longitudinally through the rotating member 13. On the outside of the rotating member 13 are raised spirals 15. On the side of the adjustable jaw 11 that is closest to the rotating member 13 is a serrated edge 16. The raised spirals 15 are in contact with the serrated edge 16, and when the rotating member 13 is turned, the raised spirals 15 cause the serrated edge 16 to move horizontally. FIG. 2 provides additional detail regarding the crescent wrench aspect of the present invention.

The present invention can be used as a hammer 1, pipe wrench 2 and crescent wrench 3 and has been found to be particularly useful in the oil field industry, where the necessity for this particular combination of tools arises frequently, in part due to the high number of fittings on an oil rig. Although initially invented for use in the oil field, the present invention is not limited to use in any particular industry or application and can also be used in farming, ranching, and plumbing, as well as for basic mechanic work or around the house.

The hammer head portion 1 of the present invention can be used for pounding nails, screws, covers, lids, etc., or for any other purpose for which a hammer is typically used. The crescent wrench 3 can be used for tightening or loosening nuts and bolts of all different sizes. The pipe wrench 2 can not only be used to tighten and loosen pipe of all different shapes and sizes, but it can also be used on those nuts and/or bolts that a crescent wrench is unable to grip. For example, if a bolt has been stripped and the crescent wrench is unable to get a good hold on the bolt, the pipe wrench could be used to grip the bolt and manipulate it in the required fashion.

The tool of the present invention is particularly designed so that both wrenches can be used in tight spaces, in situations where a tool with both wrenches on the same end (as in prior art) would not work. This is accomplished by placing the wrenches on opposite ends of the tool and by providing a handle that is long enough to separate the two wrenches functionally but not so long that it inhibits the user's ability to work in a tight space. Accordingly, the preferred range for the length of the handle (as measured from points A to B on FIG. 1) is between four and ten inches, and the preferred range for the length of the entire tool is between ten and twenty-four inches. As shown in FIG. 3, the handle optionally includes finger grips that facilitates handling. The finger grips can be formed out of the same material as the handle itself, or they can be made out of a separate piece of material, such as rubber, that is wrapped around the outside of the handle.

The present invention can be made of any rigid, durable material that can withstand the pressures associated with its use as a hand tool. In the preferred embodiment, the present invention is made of chrome-plated forged steel.

Although the preferred embodiment of the present invention has been shown and described, it will be apparent to those skilled in the art that many changes and modifications may be made without departing from the invention in its broader aspects.

The appended claims are therefore intended to cover all such changes and modifications as fall within the true spirit and scope of the invention.

I claim:

1. A combination tool comprising a hammer head portion, a pipe wrench, a crescent wrench and a handle, wherein the pipe wrench comprises an adjustable jaw and a fixed jaw, wherein the adjustable jaw of the pipe wrench comprises a serrated shank and a nut, wherein the handle comprises a horizontal protrusion, wherein the nut is confined between the hammer head portion and the horizontal protrusion, wherein the adjustable jaw of the pipe wrench is moved by turning the nut, wherein the crescent wrench comprises an adjustable jaw, a fixed jaw, and a rotating member, wherein the rotating member is attached to the body of the crescent wrench by a pin, wherein the rotating member comprises raised spirals, wherein the adjustable jaw of the crescent wrench comprises a serrated edge, wherein the raised spirals are in contact with the serrated edge, wherein the adjustable jaw of the crescent wrench is moved by turning the rotating member, wherein the crescent wrench is located on one end of the tool and the pipe wrench is located on the opposite end of the tool, and wherein the fixed jaw of the pipe wrench lies directly on top of the hammer head portion.

2. The combination tool of claim 1, further comprising finger grips on the handle.

3. The combination tool of claim 2, wherein the finger grips are formed out of the same material as the handle.

4. The combination tool of claim 2, wherein the finger grips are made out of a separate piece of material that is wrapped around the outside of the handle.

5. The combination tool of claim 4, wherein the material is rubber.

6. The combination tool of claim 1, wherein the length of the handle is in the range of four to ten inches.

7. The combination tool of claim of claim 1, wherein the overall length of the tool is in the range of ten to twenty-four inches.

8. The combination tool of claim 1, wherein the tool is made of forged steel.

9. The combination tool of claim 8, wherein the forged steel is chrome-plated.

* * * * *